US008336707B2

(12) United States Patent
Buchheit

(10) Patent No.: US 8,336,707 B2
(45) Date of Patent: Dec. 25, 2012

(54) PACKAGING BABY APPAREL ITEMS IN THE SHAPE OF A BAKED GOOD

(76) Inventor: Kathy-Lynn Buchheit, Port St. Lucie, FL (US)

( * ) Notice: Subject to any disclaimer, the term of this patent is extended or adjusted under 35 U.S.C. 154(b) by 1163 days.

(21) Appl. No.: 11/683,533

(22) Filed: Mar. 8, 2007

(65) Prior Publication Data

US 2008/0217387 A1 Sep. 11, 2008

(51) Int. Cl.
*B65D 69/00* (2006.01)
*B65D 71/00* (2006.01)

(52) U.S. Cl. ..... 206/223; 428/7

(58) Field of Classification Search ..... 206/223, 206/575, 525, 557, 278, 8, 457, 232, 497; 2/209.13; 428/7
See application file for complete search history.

(56) References Cited

U.S. PATENT DOCUMENTS 2,581,710 A * 1/1952 Roos ..... 206/8
3,402,807 A * 9/1968 Hatcher, Jr. ..... 206/8
3,647,218 A * 3/1972 Foley et al. ..... 273/157 R
4,219,119 A * 8/1980 Zefran ..... 206/457
4,461,790 A * 7/1984 Snider ..... 428/7
5,193,675 A * 3/1993 Otis ..... 206/278
5,551,570 A * 9/1996 Shaffer et al. ..... 206/575
6,220,440 B1 * 4/2001 Singerman ..... 206/575
6,698,336 B1 * 3/2004 Siegel et al. ..... 99/340
6,892,884 B1 * 5/2005 Fernandez ..... 206/494
7,234,477 B2 * 6/2007 de Larios et al. ..... 134/95.2
7,367,450 B2 * 5/2008 Maglione ..... 206/223
7,628,274 B2 * 12/2009 Matsuoka et al. ..... 206/497
2002/0023009 A1 * 2/2002 Ikeda ..... 705/26

* cited by examiner

*Primary Examiner* — Mickey Yu
*Assistant Examiner* — Chun Cheung
(74) *Attorney, Agent, or Firm* — Patents on Demand P.A.; Brian K. Buchheit

(57) ABSTRACT

The present invention can include a method of packaging baby apparel items in the shape of baked goods. In the method, one or more baby apparel items can be folded into a desired shape. An optional baking receptacle, enveloping apparel item, and binding element can be used. Once folded, the apparel items and optional items can form an aggregate shaped like a baked good, such as a cupcake, a tart, a loaf of bread, a pie, a cake, and a pastry roll. This shape can be formed without affixing adhesive to the baby apparel items and without creating holes in the baby apparel items. Hence, a usability and function of the baby apparel items is preserved despite the innovative shape. In one configuration, the shaping of the apparel items can be performed by agents of a storefront and can include customer selected apparel items.

16 Claims, 7 Drawing Sheets

PACKAGING BABY APPAREL ITEMS IN THE SHAPE OF A BAKED GOOD

BACKGROUND

1. Field of the Invention

The present invention relates to the field of gift packaging and, more particularly, to packaging baby apparel items in the shape of a baked good.

2. Description of the Related Art

The birth of a child is a momentous occasion, marked with the receipt of gifts and keepsakes. Friends and relatives often search to find gifts that are aesthetically pleasing, unique, and functional. Many times, these qualities are mutually exclusive. For example, a gift basket filled with infant necessities is a common gift item commercially available for purchase. Further, items marketed as one-of-a-kind are typically produced by high-end manufacturers and priced out of reach of most consumers.

A problem often encountered with many commercially available baby gifts is the use of adhesives to hold items in-place or together. While this is not an issue for items within protective containers, such as lotion or soap, adhesives do not adhere well to fabric items. The use of an adhesive on a fabric item is often detrimental to the item's function, causing hole in the fabric during removal or leaving behind a sticky residue. This sticky residue can be particularly detrimental due to potential adverse reactions between it and the sensitive skin of a baby. Pins or staples are often used when fastening fabric items. However, pins and staples create holes in the fabric when used and their removal can incur additional damage to the item.

Many commercially available baby gifts contain a predetermined list of items, with variations available based on gender. A customer purchasing such an item is unable to make modifications to the gift's contents. For example, a customer purchasing a gift bag can choose between one for a boy, with blue-colored items, one for a girl, with pink-colored items, and one that is neutral, with green-colored items. Regardless of which gendered bag the customer selects, the contents of the bag are the same, except for color.

What is needed is a unique baby gift that is affordable, with customer-configurable contents, and whose formation does not impair the function of the contents. That is, a gift that is unlike those commercially available that is created without the use of detrimental fastening items. Ideally, a customer would be able to create the gift item with a variety of content combinations for the same resultant gift configuration.

SUMMARY OF THE INVENTION

The present invention can be implemented in accordance with numerous aspects consistent with material presented herein. One aspect of the present invention can include a method of packaging baby apparel items in the shape of a baked good. In the method, one or more baby apparel items can be folded into a desired shape. An optional baking receptacle, enveloping apparel item, and binding element can be used. Once folded, the apparel and optional items can form an aggregate shaped like a baked good, such as a cupcake, a tart, a loaf of bread, a pie, a cake, and a pastry roll. This shape can be formed without affixing adhesive to baby apparel items and without creating holes in the baby apparel items. Hence, a usability and function of the baby apparel items is preserved despite the innovative shape. In one configuration, the shaping of the apparel items can be performed by agents of a storefront and can include customer selected apparel items.

Another aspect of the present invention can include a baby gift. The baby gift can include a commercially-available baking receptacle and one or more baby apparel items. Each of the baby apparel items can be packaged within the baking receptacle in such a manner that a final aggregation of the items resembles an edible baked good.

Still another aspect of the present invention can include a theme based set of gifts. The theme can be a bakery and each of the gifts in the set can resemble a different edible baked good. Each gift can be formed from one or more apparel items, a baking receptacle, and an optional binding element.

It should be noted that various aspects of the invention can be implemented as a program for controlling computing equipment to implement the functions described herein, or a program for enabling computing equipment to perform processes corresponding to the steps disclosed herein. For example, portions of an item selection and configuration process can be performed by a computer program associated with a Web site with which users interact. These programs may be provided by storing the program in a magnetic disk, an optical disk, a semiconductor memory, any other recording medium, or can also be provided as a digitally encoded signal conveyed via a carrier wave. The described program can be single program or can be implemented as multiple subprograms, each of which interact within a single computing device or interact in a distributed fashion across a network space.

The method detailed herein can also be a method performed at least in part by a service agent and/or a machine manipulated by a service agent in response to a service request. A service request can be a request to purchase a customized baby product or can be some other request relating to the purchase, configuration, packaging, distribution, and the like of the baby items described herein.

BRIEF DESCRIPTION OF THE DRAWINGS

There are shown in the drawings, embodiments which are presently preferred, it being understood, however, that the invention is not limited to the precise arrangements and instrumentalities shown.

DETAILED DESCRIPTION OF THE INVENTION

Figure 1:
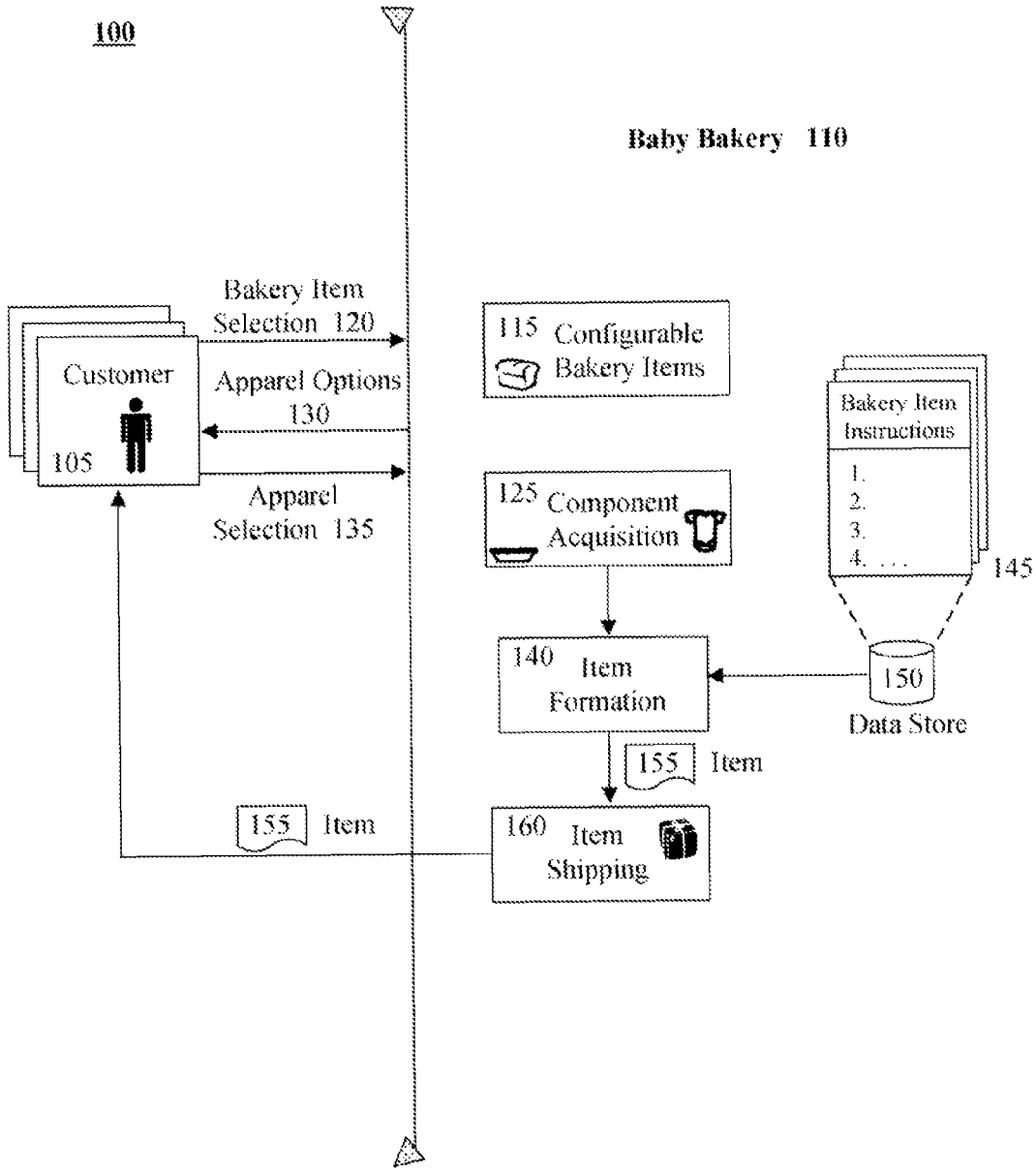
FIG. 1 is a schematic diagram illustrating a system outlining a business process for the packaging of baby apparel items in the shape of a baked good in accordance with embodiments of the inventive arrangements disclosed herein.

FIG. 1 is a schematic diagram illustrating a system 100 outlining a business process for the packaging of baby apparel items in the shape of a baked good in accordance with embodiments of the inventive arrangements disclosed herein. System 100 can include interactions between a customer 105 and the baby bakery 110. The baby baker 110 can be an entity established to provide customer 105 with baby apparel items in the shape of a baked good. The baby bakery 110 can be implemented in a variety of ways, including, but not limited to, a storefront, an e-commerce Web site, a catalog store, a combination of implementations, and the like.

It should be noted that the term 'apparel item', as used herein, defines fabric items that can be worn, in some fashion, on the body as well as cloth items having an intended use that periodically places the items against the body. This definition encompasses more than articles of clothing and includes items such as blankets, hair bands, headbands, washcloths, and the like.

It should be noted that the implementation of the baby bakery 110 can influence the manner in which the customer 105 orders and receives the final gift item 155. For example, when the baby bakery 110 is a storefront, the customer 105 can interact with a sales associate to configure the gift and receive the final gift item 155 at that time. Further, when the baby bakery 110 is an e-commerce Web site, the customer 105 can configure the gift from an Internet-capable computing device and receive the final gift 155 via a shipping carrier later. When the baby bakery 110 combines multiple implementations, it can be possible for a customer 105 to configure the item with one implementation and receive the final gift 155 at another implementation. For example, the customer 105 can order the gift via the Internet and pick up the final gift 155 at a storefront location.

The baby bakery 110 can consist of a multitude of functional units for the configuration and packaging of baby apparel items in the shape of a baked good. These units can include configurable bakery items 115, component acquisition 125, item formation 140, and item shipping 160. In addition to the functional units, the baby bakery 110 can include a data store 150 containing instructions 145 for the formation of the final gift item 155. In one contemplated configuration, the instructions 145 themselves can be a marketed item, where a consumer 105 purchases and follows the instructions 145 to create the gift item 155 on their own.

The configurable bakery items 115 unit can present the customer 105 with options for the configuration of the gift item 155. It should be noted that the presentation of the options to the customer 105 is dependent upon the implementation of the baby bakery 110. For example, an e-commerce Web site implementation can present the customer 105 with pictures and selection elements displayed in a Web page interface; a storefront implementation can present the customer 105 with physical display models.

The customer 105 can make a bakery item selection 120 from the options presented by the configurable bakery items 115 unit. The bakery item selection 120 can include additional information such as type and/or grade of baking receptacle to be used, embellishment of the baking receptacle, the type of decoration used, and the like. Upon receipt of the bakery item selection 120, the configurable bakery items 115 unit can then provide the customer 105 with apparel options 130 suitable for the selected item.

The customer 105 can then convey the apparel selection 135 corresponding to the bakery item selection 120 to the baby baker 110. The apparel selection 135 can include information such as specific apparel item types, the apparel item size, the apparel item color, the apparel item brand, an apparel store at which to purchase the apparel item, embellishment of the apparel item, and the like.

Next, the component acquisition 125 unit can obtain the items specified in the bakery item 120 and apparel selections 135. The component acquisition 125 unit can include the purchase of the apparel items, the purchase of baking receptacles, the purchase of decorative items, receipt of apparel items from the customer 105, the creation of the apparel item by baby bakery 110, the embellishment of a selected item component, and similar functions.

Once all the required components have been acquired, the item formation 140 unit can synthesize the final gift item 155 using specific, proprietary formation instructions 145. These instructions 145 can be contained within an accessible data store 150 or within a printed document. The instructions 145 can outline the process of forming a specific baked good shape with a specific configuration of apparel items.

The item formation 140 unit can produce a final gift item 155 based on the selections 120 and 135 provided by the customer 105. The gift item 155 can then proceed to the item shipping 160 unit where the item 155 can be packaged within a suitable shipping container for transit to the customer 105.

Figure 2:
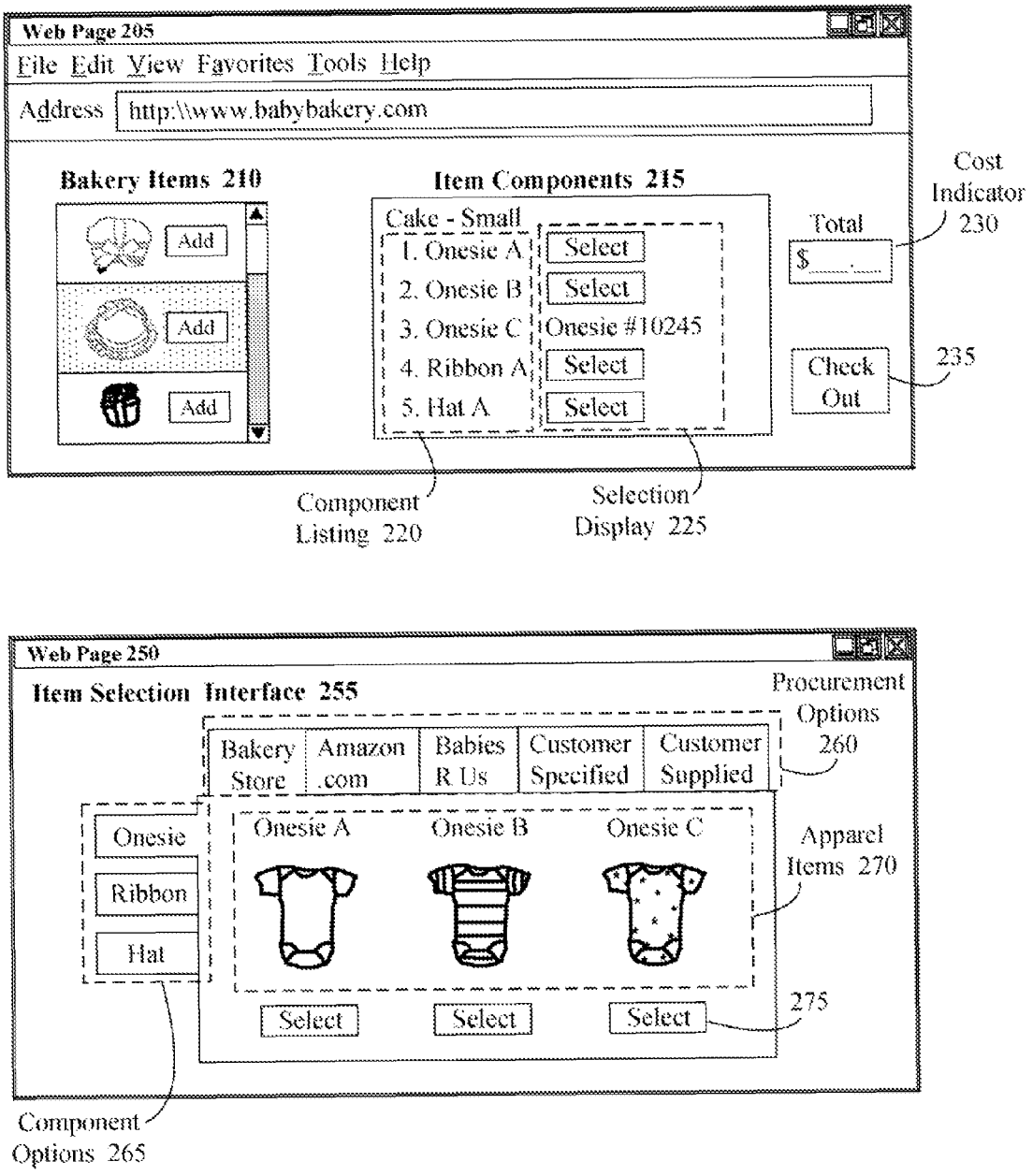
FIG. 2 is a collection of Web pages illustrating a customer interface for configuring a baby gift item in the shape of a baked good in accordance with an embodiment of the inventive arrangements disclosed herein.

FIG. 2 is a collection 200 of Web pages 205 and 250 illustrating a customer interface for configuring a baby gift item in the shape of a baked good in accordance with an embodiment of the inventive arrangements disclosed herein. The Web pages 205 and 250 can be used within the context of a system 100 to facilitate the interaction between the customer 105 and baby bakery 110.

It should be noted that the configurations shown in these drawings are for illustrative purposes only and are not intended to suggest limitations to the invention. A variety of means if available to those skilled in Web applications and Web page creation to provide the capabilities described herein. The arrangements of the Web pages 205 and 250 can be adapted for other contemplated modalities, such as a voice only modality of an interactive voice response (IVR) system.

Web page 205 can allow a customer to configure a baby gift in the shape of a baked good. In the baker items area 210, a customer can view available item shapes and select the baked good shape that the gift item will resemble. The bakery items are 210 can allow a customer to provide a bakery item selection 120 of system 100. In this example, a small cake shape is selected, as indicated by the shaded area.

Once an item is selected in the bakery items area 210, the options available to configure the item can be displayed in the item components are 215. The item components area 215 can include a component listing 220 and a corresponding selection display 225.

The component listing 220 can present the customer with a list of components available to create the selected gift item. The contents of the component listing 220 can change in response to selections made by the customer. For example, if only one small item is allowed in the selected item shape and the customer selects a pair of socks, other small items can be removed from the component listing 220, such as mittens and booties.

As the customer selects a specific item for a component, the contents of the selection display 225 can dynamically change to reflect the selections. Additionally, the selection display 225 can include a mechanism by which the customer can select specific item components. In this example, the selection display 225 contains buttons to initiate the item selection process and text corresponding to a selection.

Additionally, the Web page 205 can include a cost indicator 230 and a check out button 235. The cost indicator 230 can calculate and display the cost of selected item components as well as additional services, such as embellishments and expedited shipping. The check out button 235 can direct the customer to a payment area in order to provide payment information for the configured gift item.

Web page 250 can represent a means by which a customer can select a specific item to associate with an item component. This Web page 250 can be accessed by a customer using a button within the selection display 225 of the previous Web page 205 or by any other means provided to select item components.

Web page 250 can include an item selection interface 255. The item selection interface 255 can include procurement options 260 and component options 265. The procurement options 260 can include various means for the baby bakery to obtain a component for use in the gift. As shown in this example, the procurement options 260 can include links to e-commerce Web sites that sell baby apparel, the ability for the customer to specify a store and/or item brand, and an option where the customer supplies the baby bakery with the component.

The component options 265 can list the components necessary for the formation of the selected gift item. When a customer selects a component from the component options 265 and an option from the procurement options 260, the item selection interface 255 can display apparel items 270 that are available for the selected component and procurement option to be used in the formation of the selected bakery gift item.

In this example, the selected component is a onesie and the selected procurement option is the bakery store. Thus, the apparel items 270 displayed are a variety of onesies that are available from the bakery store. The customer can then select a specific item through a supplied mechanism, such as a select button 275. The selection of a specific item can then be reflected in the selection display of the previous Web page 250.

Figure 3:
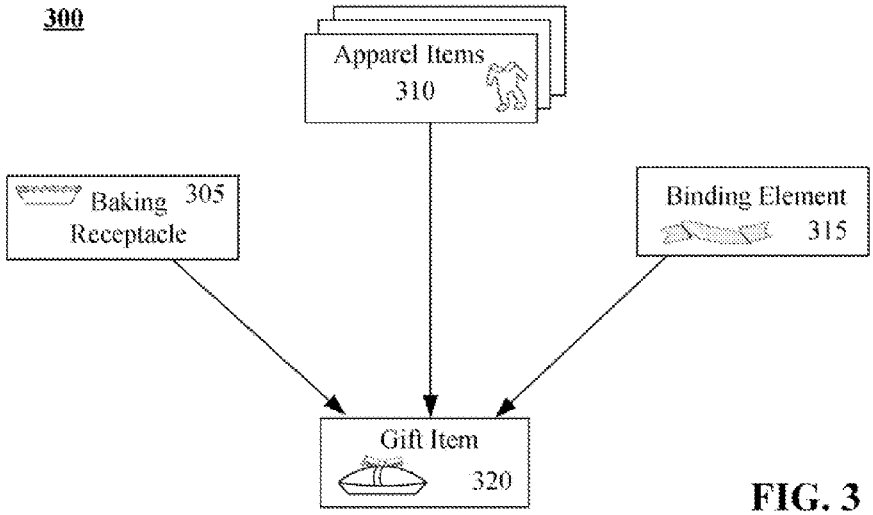
FIG. 3 is a schematic diagram of a system illustrating the components for creating a baby gift item in the shape of an edible baked good in accordance with an embodiment of the inventive arrangements disclosed herein.

FIG. 3 is a schematic diagram of a system 300 illustrating the components for creating a baby gift item 320 in the shape of an edible baked good in accordance with an embodiment of the inventive arrangements disclosed herein.

The components for the creation of a gift item 320 can include a baking receptacle 305, apparel items 310, and a binding element 315. The baking receptacle 305 can be obtained commercially and can be used for baking an actual baked good upon removal of the apparel items 310 and binding element 315. A variety of baking receptacles 305 can be used based on the desired final baked good shape of the gift item 320. For example, a cake round can be used for a gift item 320 in the shape of a cake whereas a pie pan can be used for a pie shape.

It should be appreciated that the use of an actual baking receptacle 305, not a conventional container embellished to resemble a baking receptacle, adds a distinctive quality and uniqueness to the gift item 320. Further, the baking receptacle 305 can be embellished to commemorate the occasion. For example, an infant's name and birth date can be etched onto a glass baking receptacle 305, creating a functional keepsake.

In addition to the functional baking receptacle 305, the gift item 320 can also include apparel items 310 for the baby. Different baked good shapes can require different combinations of apparel items 310. That is, the size and quantity of apparel items 310 used to create a loaf-shaped gift item 320 can be different from the size and quantity necessary to create a tart-shaped gift item 320. For example, a loaf-shaped gift item 320 can use a receiving blanket, which is much larger than the washcloth that can be used to crate a tart-shaped gift item 320.

A binding element 315 can be used to couple the apparel items 310 to the baking receptacle 305. The binding element 315 can include items such as ribbon, twist ties, and apparel items, such as hair bands. It should be appreciated that the binding element 315 does not introduce any foreign substances onto the apparel items 310 or baking receptacle 305 that could potentially damage the items 310. The use of a binding element 315, therefore, preserves the usability and function of the apparel items 310. For example, a ribbon can be tied around the baking receptacle 305 and apparel items 310 without the use of adhesive or intrusive fasteners, such as glue and pins, which can create holes or leave behind an unwanted residue.

Figure 3A:
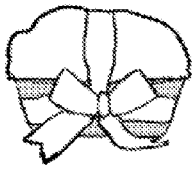
FIGS. 3A, 3B, 3C, 3D, 3E, and 3F each illustrate a specific configuration of a baby gift item shaped like an edible baked good: a bread loaf, a tart, a cake, a cupcake, a pie, and a pastry roll, respectively.
Figure 3B:
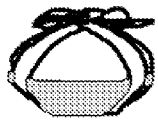
Figure 3C:
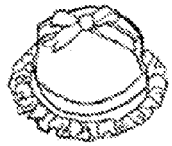
Figure 3D:
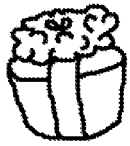
Figure 3E:
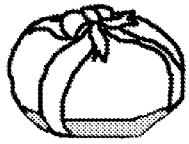
Figure 3F:
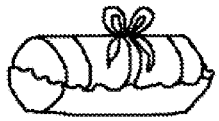

The gift item 320 can be implemented in numerous embodiments consistent with material presented herein. A few of these embodiments, which are not intended to be comprehensive, are expressed in FIGS. 3A-3F. FIG. 3A depicts a gift item 320 in the shape of a small bread loaf. FIG. 3B depicts a gift item 320 in the shape of a tart. FIG. 3C depicts a gift item 320 in the shape of a cake. FIG. 3D depicts a gift item 320 in the shape of a cupcake. FIG. 3E depicts a gift item 320 in the shape of a pie. FIG. 3F depicts a gift item 320 in the shape of a pastry roll.

Figure 4:
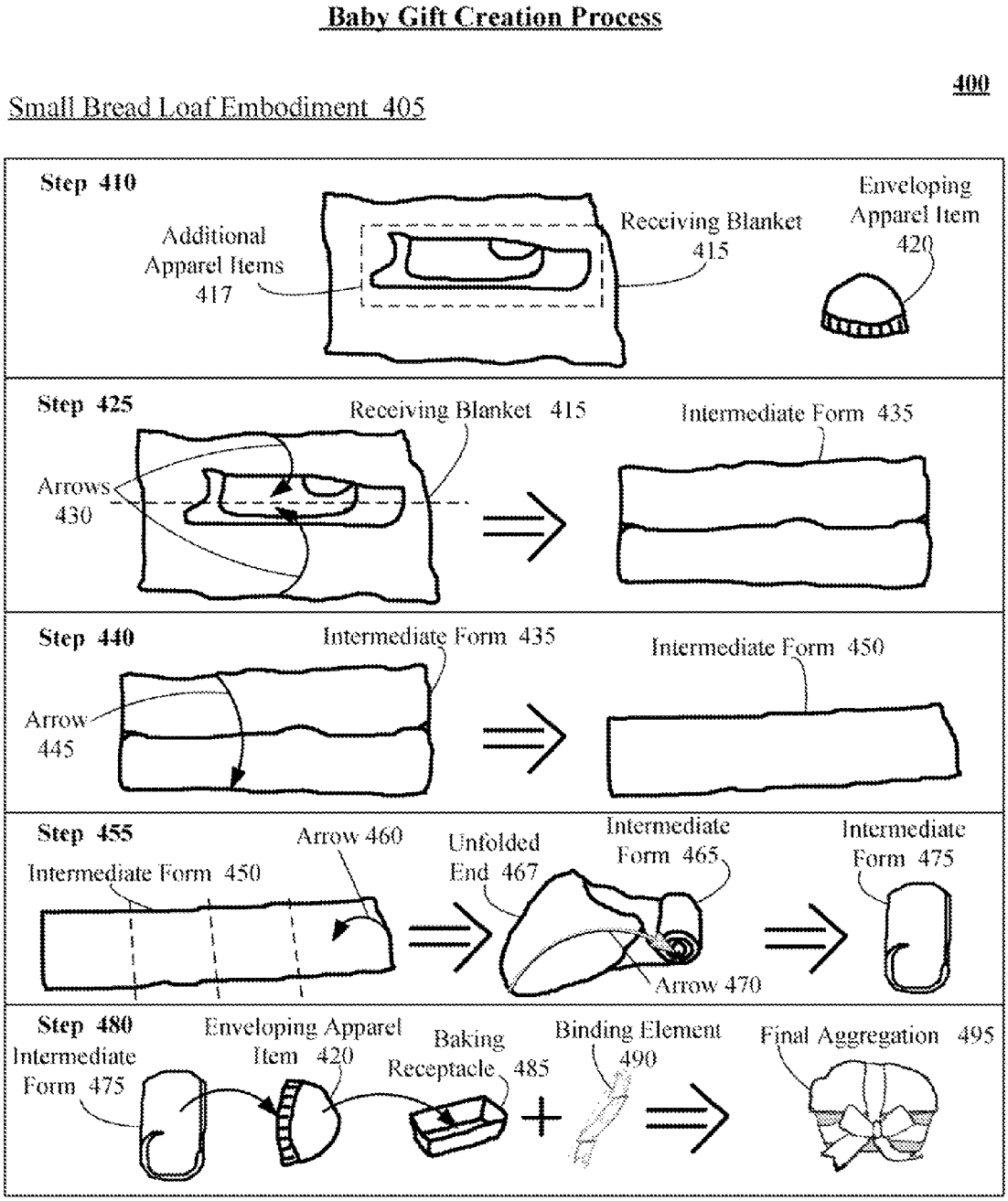
FIG. 4 is an illustration of a formation process for a small bread loaf embodiment of a baby gift item in the shape in accordance with an embodiment of the inventive arrangements disclosed herein.

FIG. 4 is an illustration of a formation process 400 for a small bread loaf embodiment 405 of a baby gift item in the shape of a baked good in accordance with an embodiment of the inventive arrangements disclosed herein. Formation process 400 can be performed in the context of a system 300 and used to create the loaf-shaped gift item of FIG. 3A.

It can assumed that all required component items are available for use at the start of the process 400. The formation process 400 can begin with step 410 where all of the necessary apparel items can be gathered. A receiving blanket 415 can be laid out lengthwise. Additional apparel items 417, except the enveloping apparel item 420, can be centrally placed upon the receiving blanket 415. In this example, the enveloping apparel item 420 is a baby hat.

In step 425, the lateral sides of the receiving blanket 415 can be formed to the longitudinal midline, as shown by the arrows 430. The folding can result in intermediate form 435. In step 440, a lateral side of the intermediate form 435 can be folded to the opposite lateral side, as shown by arrow 445, resulting in intermediate form 450.

In step 455, a longitudinal end of the intermediate form 450 can be tightly rolled three-fourths of the way towards the opposite end, as shown by arrow 460. Once rolling is complete, the remaining end of the receiving blanket 415 can be unfolded to resemble intermediate form 465. The unfolded end 467 can then be tucked into the ends of the roll of intermediate form 465, as indicated by arrow 470, resulting in intermediate form 475.

In step 480, the intermediate form 475 can be placed within the enveloping apparel item 420 and then the baking receptacle 485. Since this process 400 creates a loaf-shaped gift, the baking receptacle 485 can be a small loaf pan. A binding element 490 can then be used to decorate and secure the apparel items to the baking receptacle 485, concluding with a final aggregation 495.

Figure 5:
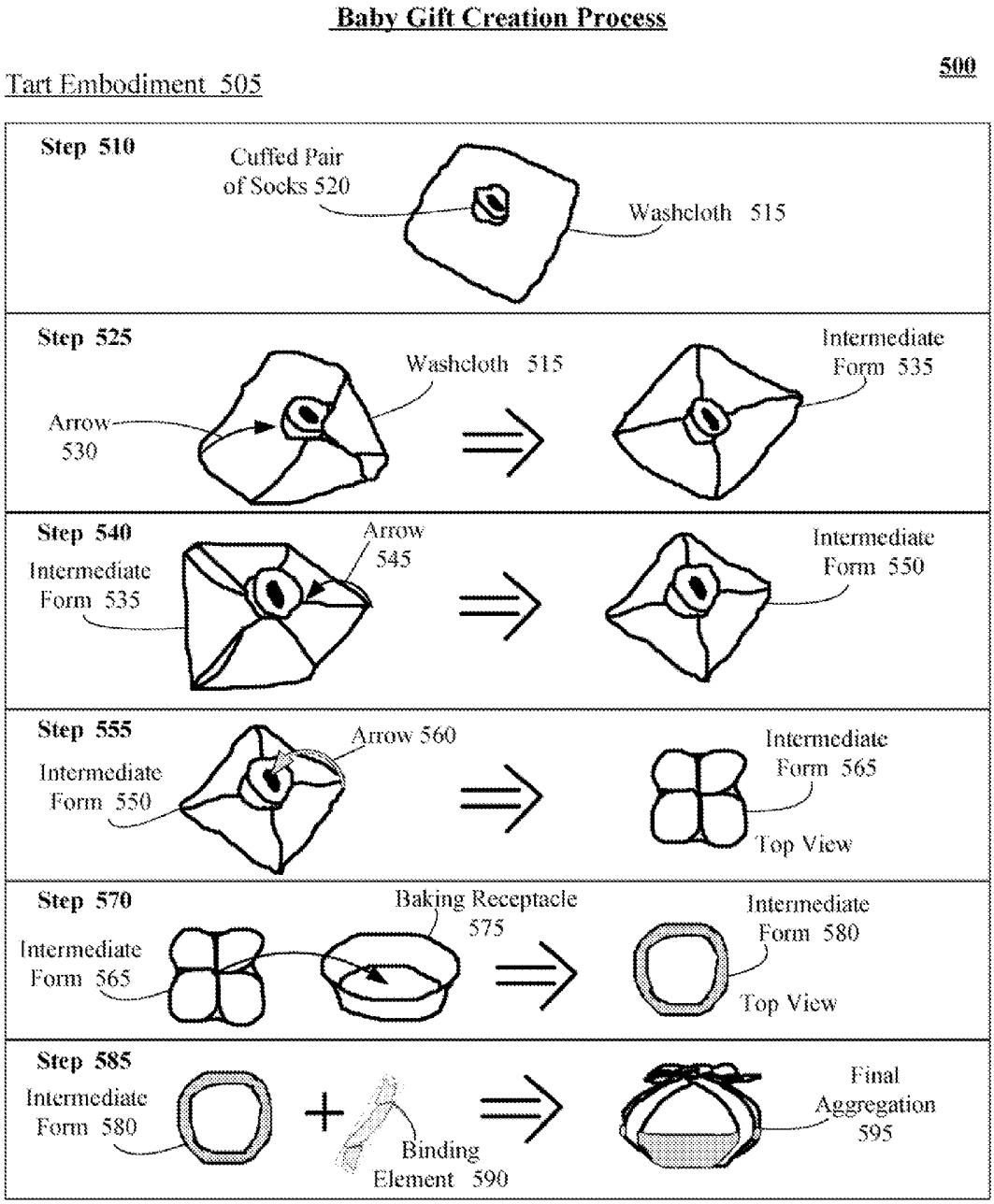
FIG. 5 is an illustration of a formation process for a tart embodiment of a baby gift item in the shape in accordance with an embodiment of the inventive arrangements disclosed herein.

FIG. 5 is an illustration of a formation process 500 for a tart embodiment 505 of a baby gift item in the shape in accordance with an embodiment of the inventive arrangements disclosed herein. Formation process 500 can be performed in the context of system 300 and used to create the tart-shaped gift item of FIG. 3B.

It can be assumed that all required component items are available for use at the start of the process 500. The formation process 500 can begin with step 510 where the necessary apparel items can be gathered. This embodiment 505 can be created with a washcloth 515 and a pair of baby socks that have been cuffed 520. The cuffed socks 520 can be placed in the center of the washcloth 515.

In step 525, the four corners of the washcloths 515 can be folded to the base of the socks 520, as shown by arrow 530. Once all four corners are folded, the component can resemble intermediate form 535. In step 540, the four corners of intermediate form 535 can be folded towards the base of the socks 520, as shown by arrow 545. Step 540 can result in intermediate form 550.

In step 555, the four corners of the intermediate form 550 can be tucked into the opening of the cuffed socks 520, as shown by arrow 560. This can result in intermediate form 565. In step 570, the intermediate form 565 can be placed within a baking receptacle 575, resulting in intermediate form 580. Since this process 500 creates the tart embodiment 505, the baking receptacle 575 can be a tart pan.

In step 585, a binding element 590 can be added to decorate and secure the intermediate form 580 to the baking receptacle 575. Upon completion of step 585, the final aggregation 595 can be achieved for the tart embodiment 505.

Figure 6:
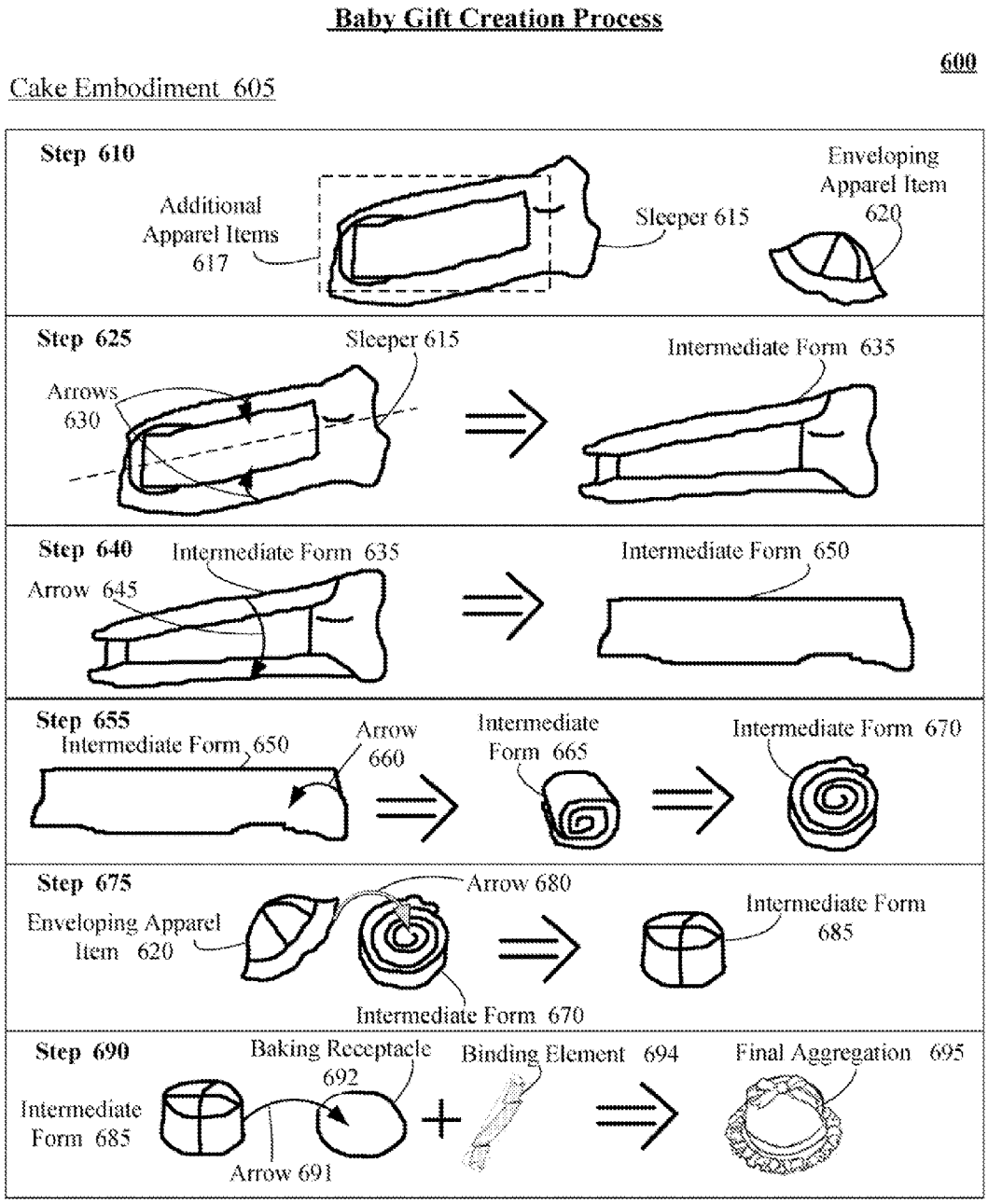
FIG. 6 is an illustration of a formation process for a cake embodiment of a baby gift item in the shape in accordance with an embodiment of the inventive arrangements disclosed herein.

FIG. 6 is an illustration of a formation process 600 for a cake embodiment 605 of a baby gift item in the shape in accordance with an embodiment of the inventive arrangements disclosed herein. Formation process 600 can be performed in the context of system 300 and used to create the cake-shaped gift item of FIG. 3C.

It can be assumed that all required component items are available for use at the start of the process 600. The formation process 600 can begin with step 610 where all of the necessary apparel items can be gathered. An infant sleeper 610 can be laid out lengthwise. Additional apparel items 617, except the enveloping apparel item 620, can be centrally placed upon the sleeper 615. In this example, the enveloping apparel item 620 is a baby hat.

In step 625, the rounded lateral sides of the sleeper 615 can be folded halfway towards the longitudinal midline, as shown by the arrows 630. Folding the sleeper 615 in this manner can result in intermediate form 635, having more of a rectangular shape than the irregular shape of the sleeper 615.

In step 640, a lateral side of the intermediate form 635 can be folded to the opposite lateral side, as shown by arrow 645, resulting in intermediate form 650. A longitudinal end of the intermediate form 650 can be tightly rolled to the opposite end, as shown by arrow 660, in step 655. The resultant shape can resemble intermediate form 665. Intermediate form 665 can then be stood up on an end to create intermediate form 670.

In step 675, the enveloping apparel item 620 can be placed over the intermediate form 670, as indicated by arrow 680. The resultant item can resemble intermediate form 685.

In step 690, the intermediate form 685 can be placed on the baking receptacle 692, as shown by arrow 691. Since this process 600 creates the cake embodiment 605, the baking receptacle 692 can be a cake round. A binding element 694 can then decorate and secure the intermediate form 685 to the baking receptacle 692, resulting in the final aggregation 695.

It should be appreciated that the baking receptacle 692 can also be decorated to complete the overall look of a continuous baked good. For example, the perimeter of the cake round can be covered with eyelet to make the final aggregation 695 look like a cake decorated to look like a baby's bonnet.

Figure 7:
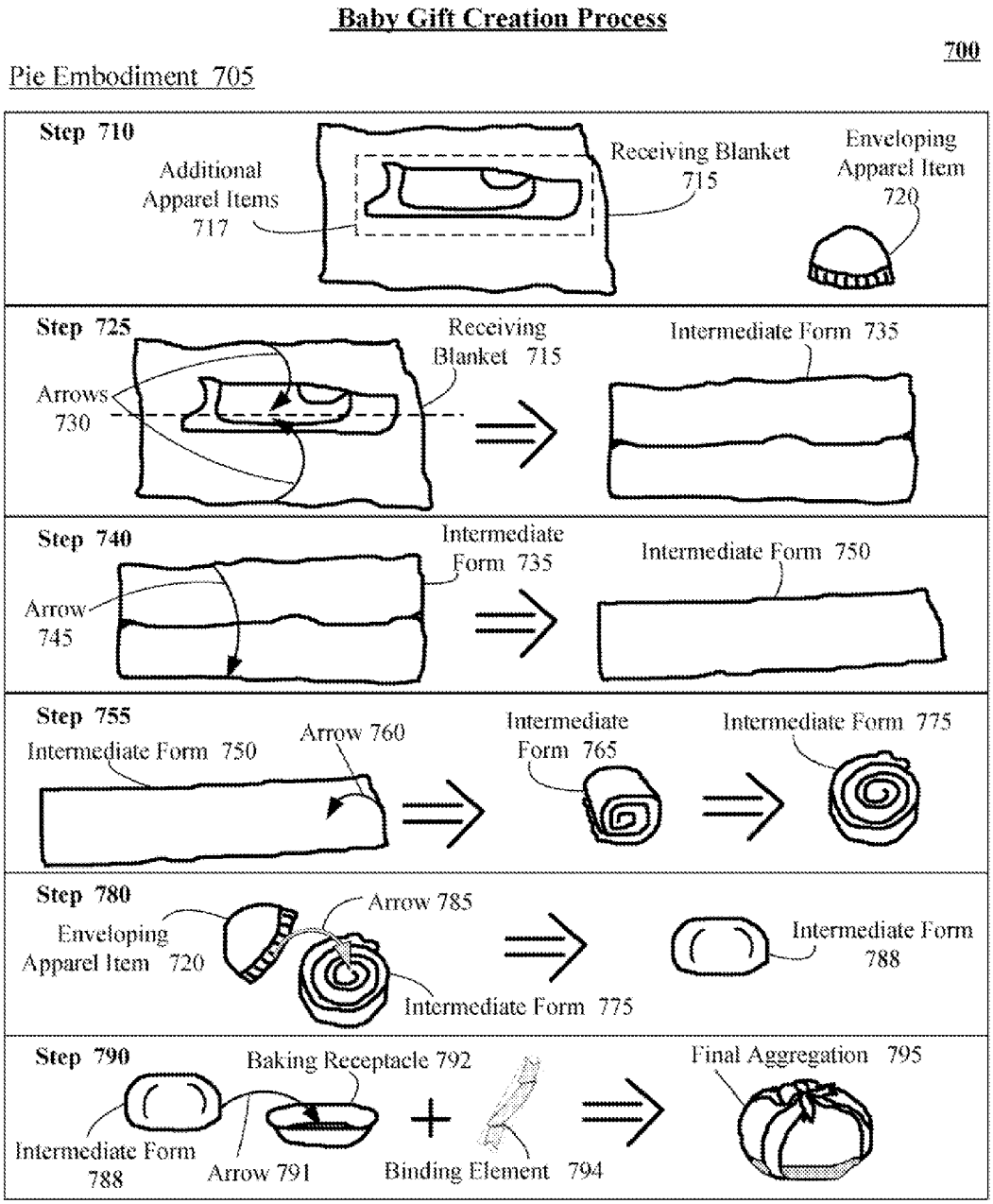
FIG. 7 is an illustration of a formation process for a pie embodiment of a baby gift item in the shape in accordance with an embodiment of the inventive arrangements disclosed herein.

FIG. 7 is an illustration of a formation process 700 for a pie embodiment 705 of a baby gift item in the shape in accordance with an embodiment of the inventive arrangements disclosed herein. Formation process 700 can be performed in the context of system 300 and used to create the pie-shaped gift item of FIG. 3E.

It can be assumes that all required component items are available for use at the start of the process 700. The formation process 700 can begin with step 710 where all of the necessary apparel items can be gathered. A receiving blanket 715 can be laid out lengthwise. Additional apparel items 717, except the enveloping apparel item 720, can be centrally placed upon the receiving blanket 715. In this example, the enveloping apparel item 720 is a baby hat.

In step 725, the lateral sides of the receiving blanket 715 can be folded to the longitudinal midline, as shown by the arrows 730. The folding can result in intermediate form 735. In step 740, a lateral side of the intermediate form 735 can be folded to the opposite lateral side, as shown by arrow 745, resulting in intermediate form 750.

A longitudinal end of the intermediate form 750 can be tightly rolled to the opposite end, as shown by arrow 760, in step 755. The resultant shape can resemble intermediate form 765. Intermediate form 765 can then be stood up on an end to create intermediate form 775.

In step 780, the enveloping apparel item 720 can be placed over the intermediate form 770, as indicated by arrow 785. The resultant item can resemble intermediate form 788.

In step 790, the intermediate form 788 can be placed on the baking receptacle 792, as shown by arrow 791. Since this process 700 creates the pie embodiment 705, the baking receptacle 792 can be a pie pan. A binding element 792 can then decorate and secure the intermediate form 785 to the baking receptacle 792, resulting in the final aggregation 795.

This invention may be embodied in other forms without departing from the spirit or essential attributes thereof. Accordingly, reference should be made to the following claims, rather than to the foregoing specification, as indicating the scope of the invention.

What is claimed is:

1. A baby gift comprising:

a commercially-available baking receptacle; and a plurality of baby apparel items, wherein the plurality of items are packaged within the baking receptacle in such a manner that a final aggregation of the items resembles an edible baked good, wherein the final aggregation comprises:

an enveloping apparel item, wherein said enveloping appeal item is one of the plurality of baby apparel items which envelop a core body, wherein a weight of the core body of baby apparel items is supported by the commercially-available baking receptacle in the final aggregation;

the core body, which comprises of a subset of the baby apparel items, wherein the core body is not visible when the final aggregate is formed but provides interior stuffing forming a shape for resembling the edible baked good in the final aggregation; and a binding element, which is either a ribbon or one of the apparel items, wherein in the final aggregation the binding element secures the plurality of baby apparel items to the commercially available baking receptacle so that the plurality of baby apparel items are removable from the commercially available baking receptacle only after removal of the binding element from the final aggregation, wherein the final aggregation results from folding and/or binding of the baby apparel items without affixing adhesive to any of the baby apparel items and without creating holes in any of the baby apparel items.

2. The baby gift of claim 1, wherein the binding element is a ribbon.

3. The baby gift of claim 1, wherein use of the binding element preserves the usability and function of the plurality of baby apparel items.

4. The baby gift of claim 1, wherein the binding element is one of the apparel items.

5. The baby gift of claim 1, wherein the final aggregation is shaped to resemble at least one of a cupcake, a tart, a loaf of bread, a pie, and a pastry roll.

6. The baby gift of claim 1, wherein the baking receptacle is at least one of a loaf pan, a pie pan, a tart pan, a paper baking cup, and a muffin tin.

7. The baby gift of claim 1, wherein the baby gift is a packaging of the baby apparel items in a shape of the edible baked good, wherein the baby gift is formed by:

folding the plurality of customer selected baby apparel items into a desired shape; and binding the folded at least one apparel item, whereby a lack of adhesive affixed to the baby apparel items and a lack of holes created for packaging purposes ensures a usability and function of the baby apparel items is preserved.

8. The baby gift of claim 7, wherein the folded at least one apparel item forms the core body for the final aggregation.

9. The baby gift of claim of claim 7, wherein said customer selection of the baby apparel items occurs through a Web page maintained by a provider of the baby gift.

10. A theme based set of gifts comprising:

a plurality of gift item shapes, each shape resembling an edible baked good and containing a plurality of apparel items, a baking receptacle, and a binding element, wherein each of the gift item shapes comprises:

an enveloping apparel item, wherein said enveloping appeal item is one of the plurality of apparel items which envelop a core body, wherein a weight of the core body of apparel items is supported by the baking receptacle;

the core body, which comprises of a subset of the apparel items, wherein the core body is not visible but provides interior stuffing forming a corresponding one of the gift item shapes for resembling the edible baked good; and the binding element, which is either a ribbon or one of the apparel items, wherein the binding element secures the plurality of apparel items to the baking receptacle so that the plurality of apparel items are removable from the baking receptacle only after removal of the binding element, wherein the corresponding one of the gift item shapes results from folding and/or binding of the apparel items without affixing adhesive to any of the apparel items and without creating holes in any of the apparel items.

11. The set of gifts of claim 10, wherein the plurality of gift item shapes includes at least two of a cake, a tart, a cupcake, a pie, a bread loaf, and a pastry roll.

12. The set of gifts of claim 10, wherein the binding element is the ribbon for at least one of the gift item shapes.

13. The set of gifts of claim 10, wherein the use of the binding element preserves the usability and function of the plurality of apparel items, wherein the plurality of gift item shapes includes at least three of a cake, a tart, a cupcake, a pie, a bread loaf, and a pastry roll.

14. The set of gifts of claim 10, wherein the plurality of gift item shapes includes at least two of a cake, a tart, a cupcake, a pie, a bread loaf, and a pastry roll, and wherein the baking receptacles include at least one of a loaf pan, a pie pan, a tart pan, a paper baking cup, a muffin tin, and a cake round, wherein the baking receptacle used represents a baking receptacle typically used for a baked good to which the gift item shape corresponds.

15. The set of gifts of claim 10, wherein each of the gifts is a baby gift, and wherein each of the apparel items is a baby apparel item, wherein the plurality of gift item shapes includes at least two of a tart, a cupcake, a pie, a bread loaf, and a pastry roll.

16. The set of gifts of claim 10, wherein the plurality of apparel items, the baking receptacle, and the binding element are being transformed into the theme based set of gifts based on a set of instructions utilized by workers.

* * * * *